US007847782B2

(12) United States Patent
Sohn et al.

(10) Patent No.: US 7,847,782 B2
(45) Date of Patent: Dec. 7, 2010

(54) METHOD AND APPARATUS FOR DRIVING LIQUID CRYSTAL DISPLAY

(75) Inventors: Min Ho Sohn, Gwangmyung-shi (KR); Seong Ho Baik, Gwacheon-shi (KR)

(73) Assignee: LG. Display Co., Ltd., Seoul (KR)

( * ) Notice: Subject to any disclaimer, the term of this patent is extended or adjusted under 35 U.S.C. 154(b) by 1250 days.

(21) Appl. No.: 10/880,220

(22) Filed: Jun. 28, 2004

(65) Prior Publication Data

US 2005/0104841 A1 May 19, 2005

(30) Foreign Application Priority Data

Nov. 17, 2003 (KR) ..... 10-2003-0081173

(51) Int. Cl.
*G09G 3/36* (2006.01)

(52) U.S. Cl. ..... 345/102; 345/89; 345/690; 348/672; 348/678

(58) Field of Classification Search ..... 345/88–89, 345/690, 102; 348/671–672, 678
See application file for complete search history.

(56) References Cited

U.S. PATENT DOCUMENTS 6,373,979 B1 * 4/2002 Wang ..... 345/589
6,778,183 B1 * 8/2004 Nair et al. ..... 345/589
7,129,975 B2 * 10/2006 Levine et al. ..... 348/246
2001/0033260 A1 * 10/2001 Nishitani et al. ..... 345/87
2002/0057238 A1 * 5/2002 Nitta et al. ..... 345/87
2002/0070914 A1 * 6/2002 Bruning et al. ..... 345/102
2003/0002736 A1 * 1/2003 Maruoka et al. ..... 382/168
2003/0020974 A1 * 1/2003 Matsushima ..... 358/521
2003/0151565 A1 * 8/2003 Kim et al. ..... 345/60
2003/0222841 A1 * 12/2003 Hirosue ..... 345/89

* cited by examiner

*Primary Examiner*—Alexander Eisen
*Assistant Examiner*—Michael Pervan
(74) *Attorney, Agent, or Firm*—Brinks Hofer Gilson & Lione

(57) ABSTRACT

A driving method and apparatus for a liquid crystal display is provided in which a contrast ratio of data to be displayed can be expanded and the brightness of a back light can be changed using an accumulated result of a plurality of frames. In the driving method, data to be displayed is converted into brightness components and arranged into a histogram for each frame. Second data having an expanded contrast is generated using the histograms of at least two frames, including the histogram of the current frame. Averages of the histograms are calculated and used to control the brightness of the back light. The averages may be weighted such that frames closer to the current frame have a larger effect.

8 Claims, 11 Drawing Sheets

METHOD AND APPARATUS FOR DRIVING LIQUID CRYSTAL DISPLAY

This application claims the benefit of Korean Patent Application No. P2003-81173 filed in Korea on Nov. 17, 2003, which is hereby incorporated by reference.

BACKGROUND OF THE INVENTION

1. Field of the Invention

This invention relates to a liquid crystal display, and more particularly to a driving method and apparatus for a liquid crystal display in which the contrast ratio of data to be displayed can be expanded and the brightness of a back light can be changed with the aid of an accumulated result of a plurality of frames.

2. Description of the Related Art

Generally, a liquid crystal display (LCD) controls light transmittance of liquid crystal cells in accordance with video signals to thereby display a picture. Such an LCD has been implemented by an active matrix type having a switching device for each cell, and applied to a display device such as a monitor for a computer, office equipments, a cellular phone and the like. The switching device for the active matrix LCD mainly employs a thin film transistor (TFT).

FIG. 1 schematically shows a conventional LCD driving apparatus.

Referring to FIG. 1, the conventional LCD driving apparatus includes a liquid crystal display panel 2 having m×n liquid crystal cells Clc arranged in a matrix type, m data lines D1 to Dm and n gate lines G1 to Gn intersecting each other and thin film transistors TFT provided at the intersections, a data driver 4 for applying data signals to the data lines D1 to Dm of the liquid crystal display panel 2, a gate driver 6 for applying scanning signals to the gate lines G1 to Gn, a gamma voltage supplier 8 for supplying the data driver 4 with gamma voltages, a timing controller 10 for controlling the data driver 4 and the gate driver 6 using synchronizing signals from a system 20, a direct current to direct current converter 14, hereinafter referred to as "DC/DC converter", for generating voltages supplied to the liquid crystal display panel 2 using a voltage from a power supply 12, and an inverter 16 for driving a back light 18.

The system 20 applies vertical/horizontal signals Vsync and Hsync, clock signals DCLK, a data enable signal DE and data R, G and B to the timing controller 10.

The liquid crystal display panel 2 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 8 applies a plurality of gamma voltages to the data driver 4.

The data driver 4 converts digital video data R, G and B into analog gamma voltages (i.e., data signals) corresponding to gray level values in response to a control signal CS from the timing controller 10, and applies the analog gamma voltages to the data lines D1 to Dm.

The gate driver 6 sequentially applies a scanning pulse to the gate lines G1 to Gn in response to a control signal CS from the timing controller 10 to thereby select horizontal lines of the liquid crystal display panel 2 supplied with the data signals.

The timing controller 10 generates the control signals CS for controlling the gate driver 6 and the data driver 4 using the vertical/horizontal synchronizing signals Vsync and Hsync and the clock signal DCLK inputted from the system 20. The control signal CS for controlling the gate driver 6 is comprised of a gate start pulse GSP, a gate shift clock GSC and a gate output enable signal GOE, etc. Further, the control signal CS for controlling the data driver 4 is comprised of a source start pulse SSP, a source shift clock SSC, a source output enable signal SOE and a polarity signal POL, etc. The timing controller 10 re-aligns the data R, G and B from the system 20 to apply them to the data driver 4.

The DC/DC converter 14 boosts or drops a voltage of 3.3V inputted from the power supply 12 to generate a voltage supplied to the liquid crystal display panel 2. Such a DC/DC converter 14 generates a gamma reference voltage, a gate high voltage VGH, a gate low voltage VGL and a common voltage Vcom, etc.

The inverter 16 applies a driving voltage (or driving current) for driving the back light 18 to the back light 18. The back light 18 generates light corresponding to the driving voltage (or driving current) from the inverter 16 to apply it to the liquid crystal display panel 2.

In order to display a vivid image on the liquid crystal display panel 2 driven in this manner, a distinct contrast between brightness and darkness must be made in correspondence with data to be displayed. However, since the conventional back light 18 produces a constant brightness irrespective of the data, it is difficult to display a dynamic and fresh image.

SUMMARY OF THE INVENTION

Accordingly, a driving method and apparatus for a liquid crystal display are presented in which the contrast ratio of the data can be expanded and the brightness of a back light can be changed with the aid of an accumulated result of a plurality of frames.

In one aspect of the invention, a method of driving a liquid crystal display according to one aspect of the present invention includes converting first data of each frame into brightness components to arrange the data into a histogram; and generating second data having an expanded contrast using histograms of at least two frames.

In the method, generating the second data includes storing the histograms; converting the stored histograms into an average value to generate an average histogram; and generating the second data using the average histogram.

Generating the average histogram includes assigning a weighting value to the stored histogram.

The weighting value assigned has increasing value with decreasing distance from the current frame.

When the average histogram is generated, higher weighting values have more effect.

The method further includes controlling brightness of a back light using the histograms.

Controlling the brightness of the back light includes extracting a control value from the average histogram; and controlling the brightness of the back light in correspondence with the control value.

Controlling the brightness of the back light includes extracting each control value from the histogram for the plurality of frames; averaging the extracted control values to calculate a control value; and controlling the brightness of the back light in correspondence with the calculated control value.

The control value is a most-frequent value or an average value of the brightness components of the histogram.

A method of driving a liquid crystal display according to another aspect of the present invention includes converting first data of each frame into brightness components and chrominance components; arranging the brightness components into a histogram; storing histograms for a plurality of frames; converting the stored histograms into an average value to generate an average histogram; converting brightness components of the average histogram to have an expanded contrast; generating second data having an expanded contrast using the converted brightness components and the chrominance components; and re-arranging the second data such that the second data can be applied to a liquid crystal display panel, thereby applying the re-arranged second data to a data driver.

The method further includes delaying the chrominance components such that the chrominance components are synchronized with the converted brightness components.

The method further includes converting synchronizing signals inputted in synchronization with the first data from the exterior to be synchronized with the second data.

Storing the histograms for the plurality of frames includes storing histograms for at least two frames adjacent to the current frame.

Generating the average histogram includes assigning a weighting value such that histograms closer to the current frame have increasing effect on the average histogram.

The method further includes controlling brightness of a back light using the histograms of the plurality of frames.

Controlling the brightness of the back light includes extracting a control value from the average histogram; and controlling the brightness of the back light in correspondence with the control value.

Controlling the brightness of the back light includes extracting each control value from the histogram for the plurality of frames; averaging the extracted control values to calculate a control value; and controlling the brightness of the back light in correspondence with the calculated control value.

A method of driving a liquid crystal display according to still another aspect of the present invention includes converting data of each frame into brightness components to arrange the data into a histogram; and controlling brightness of a back light using histograms of at least two frames.

In the method, controlling the brightness includes converting the histograms for the at least two frames into an average value to generate an average histogram; extracting a control value from the average histogram; and controlling the brightness of the back light in correspondence with the control value.

Alternatively, controlling the brightness includes extracting each control value from the histogram for the at least two frames; averaging the extracted control values to calculate a control value; and controlling the brightness of the back light in correspondence with the calculated control value.

The control value is a most-frequent value or an average value of the brightness components of the histogram.

The brightness components are divided into a plurality of brightness areas, and the brightness of the back light is controlled to correspond to a brightness area to which the control value belongs of the divided brightness areas.

The brightness of the back light is set differently for each area to which the control value belongs.

The method further includes assigning a weighting value to each of the histograms for the at least two frames such that the histogram has increasing effect with decreasing distance from the current frame with respect to the brightness of the back light.

A driving apparatus for a liquid crystal display according to still another aspect of the present invention includes a brightness/color separator for extracting brightness components from first data of each frame; a histogram analyzer for converting the brightness components into a histogram; a storage for storing histograms for at least two frames analyzed by the histogram analyzer; an average value calculator for converting the histograms for the at least two frames stored in the storage into an average value to generate an average histogram; and a data processor for converting the brightness components to have an expanded contrast using the average histogram.

The driving apparatus further includes a brightness/color mixer for generating a second data having an expanded contrast using converted brightness components and chrominance components from the data processor; and delay means for delaying the chrominance components such that the chrominance components are synchronized with the converted brightness components.

The driving apparatus further includes a weighting value assigner for assigning a weighting value in which histograms for frames closer to the current frame have an increasing effect with decreasing distance from the current frame when the average histogram is produced.

The average value calculator converts the control value from each histogram for the at least two frames to calculate an average control value.

The driving apparatus further includes a back light controller for controlling the brightness of the back light using the control value of the average histogram or the average control value.

BRIEF DESCRIPTION OF THE DRAWINGS

Embodiments of the invention will be apparent from the following detailed description of the embodiments of the present invention with reference to the accompanying drawings, in which.

DETAILED DESCRIPTION OF THE PREFERRED EMBODIMENT

Figure 1:
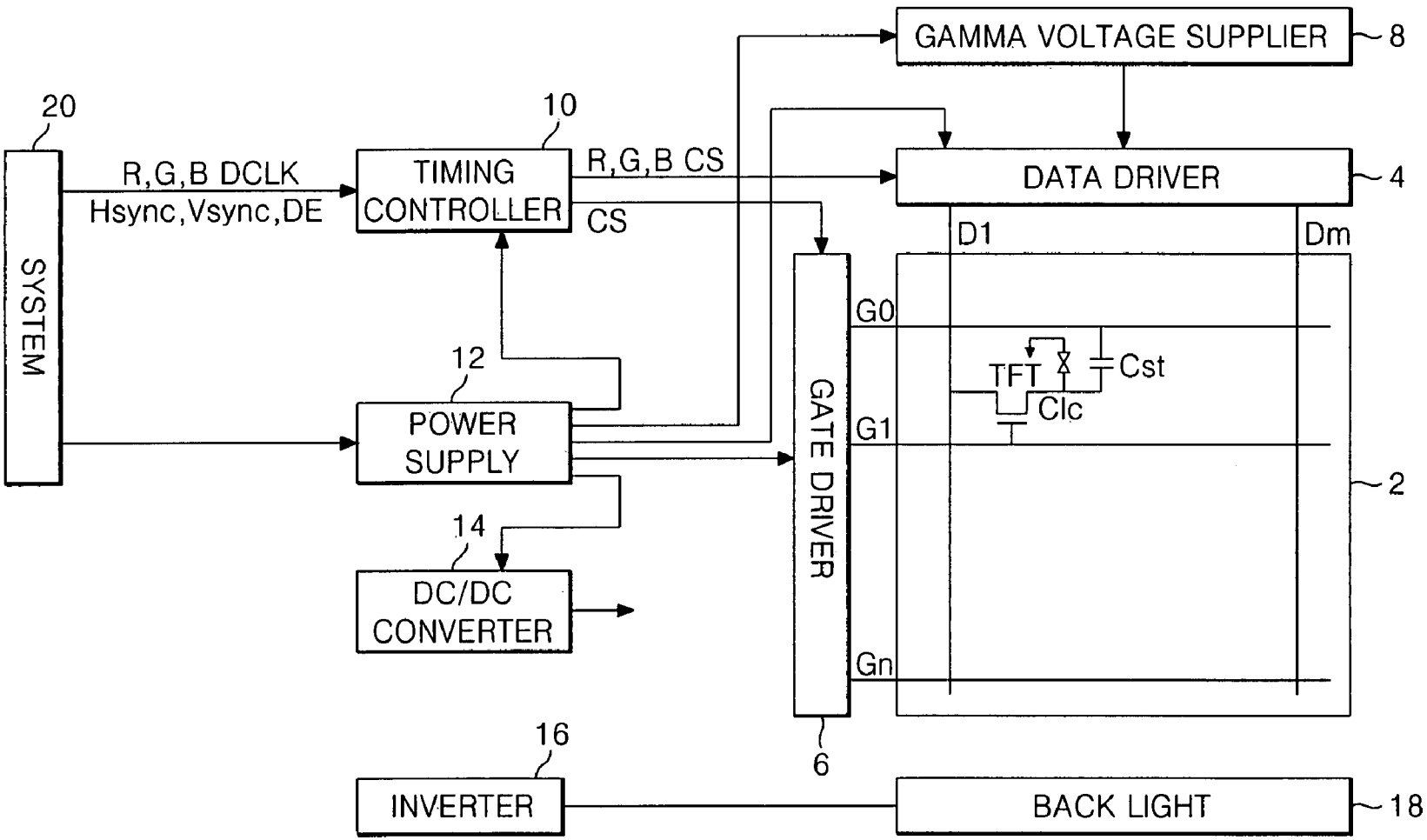
FIG. 1 RELATED ART
FIG. 1 is a schematic block diagram showing a configuration of a conventional driving apparatus for a liquid crystal display.
Figure 2:
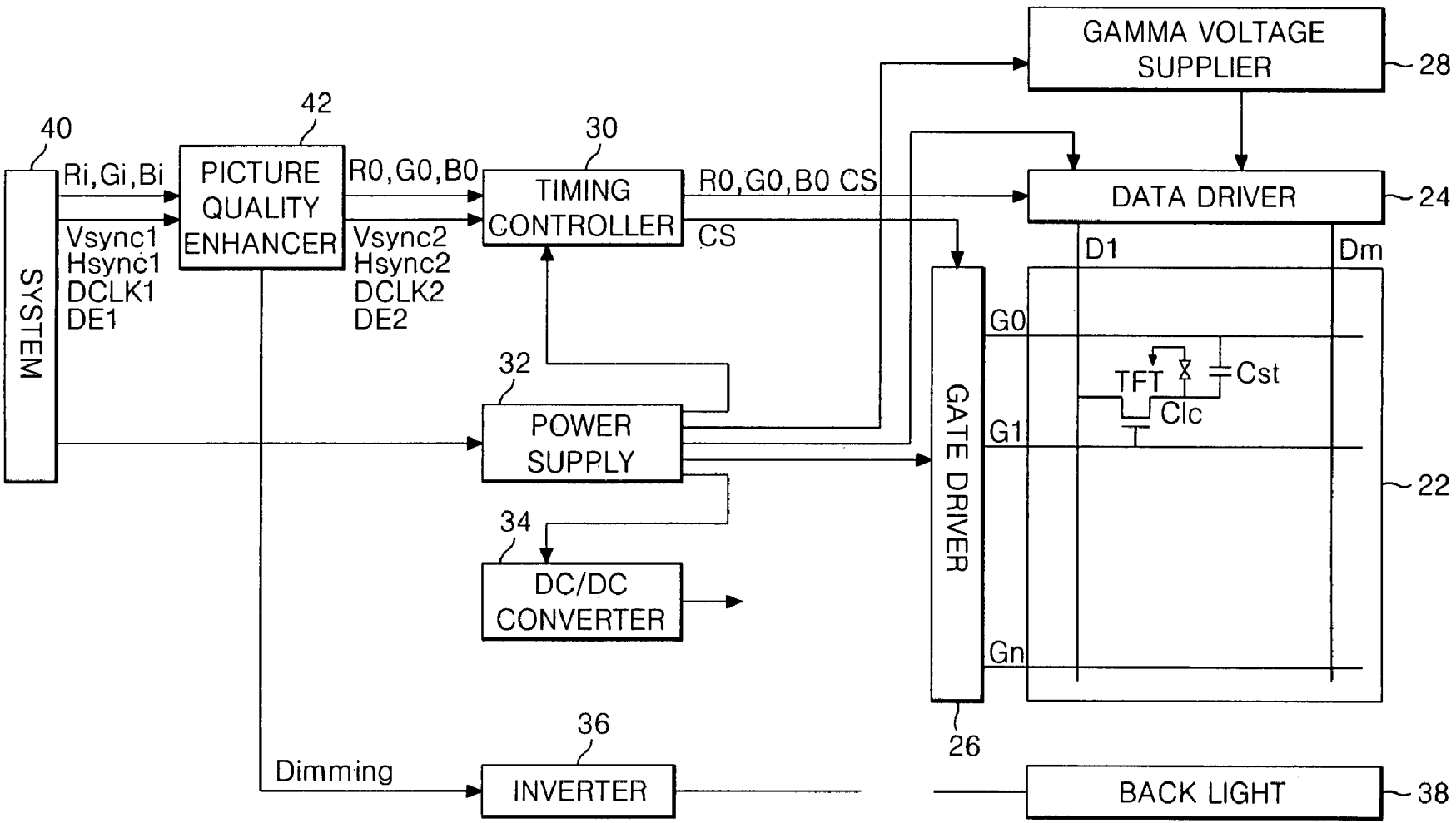
FIG. 2 is a schematic block diagram showing a configuration of a driving apparatus for a liquid crystal display according to an embodiment of the present invention.

FIG. 2 schematically shows a driving apparatus for a liquid crystal display (LCD) according to an embodiment of the present invention.

Referring to FIG. 2, the LCD driving apparatus according to the embodiment of the present invention includes a liquid crystal display panel 22 having m×n liquid crystal cells Clc arranged in a matrix type, m data lines D1 to Dm and n gate lines G1 to Gn intersecting each other and thin film transistors TFT provided at the intersections, a data driver 24 for applying data signals to the data lines D1 to Dm of the liquid crystal display panel 22, a gate driver 26 for applying scanning signals to the gate lines G1 to Gn, a gamma voltage supplier 28 for supplying the data driver 24 with gamma voltages, a timing controller 30 for controlling the data driver 24 and the gate driver 26 using a second synchronizing signal from a picture quality enhancer 42, a DC/DC converter 34 for generating voltages supplied to the liquid crystal display panel 22 using a voltage from a power supply 32, an inverter 36 for driving a back light unit 38, and a picture quality enhancer 42 for selectively emphasizing a contrast of an input data and for applying a brightness control signal Dimming corresponding to the input data to the inverter 36.

The system 40 applies first vertical/horizontal signals Vsync1 and Hsync1, a first clock signal DCLK1, a first data enable signal DE1 and first data Ri, Gi and Bi to the picture quality enhancer 42.

The liquid crystal display panel 22 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 28 applies a plurality of gamma voltages to the data driver 24.

The data driver 24 converts digital video data Ro, Go and Bo into analog gamma voltages (i.e., data signals) corresponding to gray level values in response to a control signal CS from the timing controller 30, and applies the analog gamma voltages to the data lines D1 to Dm.

The gate driver 26 sequentially applies a scanning pulse to the gate lines G1 to Gn in response to a control signal CS from the timing controller 30 to thereby select horizontal lines of the liquid crystal display panel 22 supplied with the data signals.

The timing controller 30 generates the control signals CS for controlling the gate driver 26 and the data driver 24 using second vertical/horizontal synchronizing signals Vsync2 and Hsync2 and a second clock signal DCLK2 inputted from the picture quality enhancer 42. The control signal CS for controlling the gate driver 26 is comprised of a gate start pulse GSP, a gate shift clock GSC and a gate output enable signal GOE, etc. Further, the control signal CS for controlling the data driver 24 is comprised of a source start pulse SSP, a source shift clock SSC, a source output enable signal SOE and a polarity signal POL, etc. The timing controller 30 re-aligns second data Ro, Go and Bo from the picture quality enhancer 42 to apply the second data to the data driver 24.

The DC/DC converter 34 boosts or drops a voltage of 3.3V inputted from the power supply 32 to generate a voltage supplied to the liquid crystal display panel 22. Such a DC/DC converter 14 generates a gamma reference voltage, a gate high voltage VGH, a gate low voltage VGL and a common voltage Vcom.

The inverter 36 applies a driving voltage (or driving current) corresponding to the brightness control signal Dimming from the picture quality enhancer 42 to the back light 38. In other words, a driving voltage (or driving current) applied from the inverter 36 to the back light 38 is determined by the brightness control signal Dimming from the picture quality enhancer 42. The back light 38 applies a light corresponding to the driving voltage (or driving current) from the inverter 36 to the liquid crystal display panel 22.

The picture quality enhancer 42 extracts brightness components using the first data Ri, Gi and Bi from the system 40, and generates second data Ro, Go and Bo obtained by a change in gray level values of the first data Ri, Gi and Bi in correspondence with the extracted brightness components. In this case, the picture quality enhancer 42 generates the second data Ro, Go and Bo such that the contrast is selectively expanded with respect to the input data Ri, Gi and Bi.

Further, the picture quality enhancer 42 generates a brightness control signal Dimming corresponding to brightness components to apply it to the inverter 36. The picture quality enhancer 42 extracts a control value capable of controlling the back light, for example, a most-frequent value (i.e., the gray level value occupied by the maximum number of the brightness components in the frame) and/or an average value (i.e., the average value average value of the brightness components in the frame), and generates the brightness control signal Dimming using the extracted control value. The picture quality enhancer 42 divides the brightness of the back light corresponding to gray levels of the brightness components into at least two regions, and generates the brightness control signal Dimming such that a region of the brightness is selected in correspondence with the control value.

Moreover, the picture quality enhancer 42 generates second vertical/horizontal synchronizing signals Vsync2 and Hsync2, a second clock signal DCLK2 and a second data enable signal DE2 synchronized with the second data Ro, Go and Bo with the aid of the first vertical/horizontal synchronizing signals Vsync1 and Hsync1, the first clock signal DCLK1 and the first data enable signal DE1 inputted from the system 40.

Figure 3:
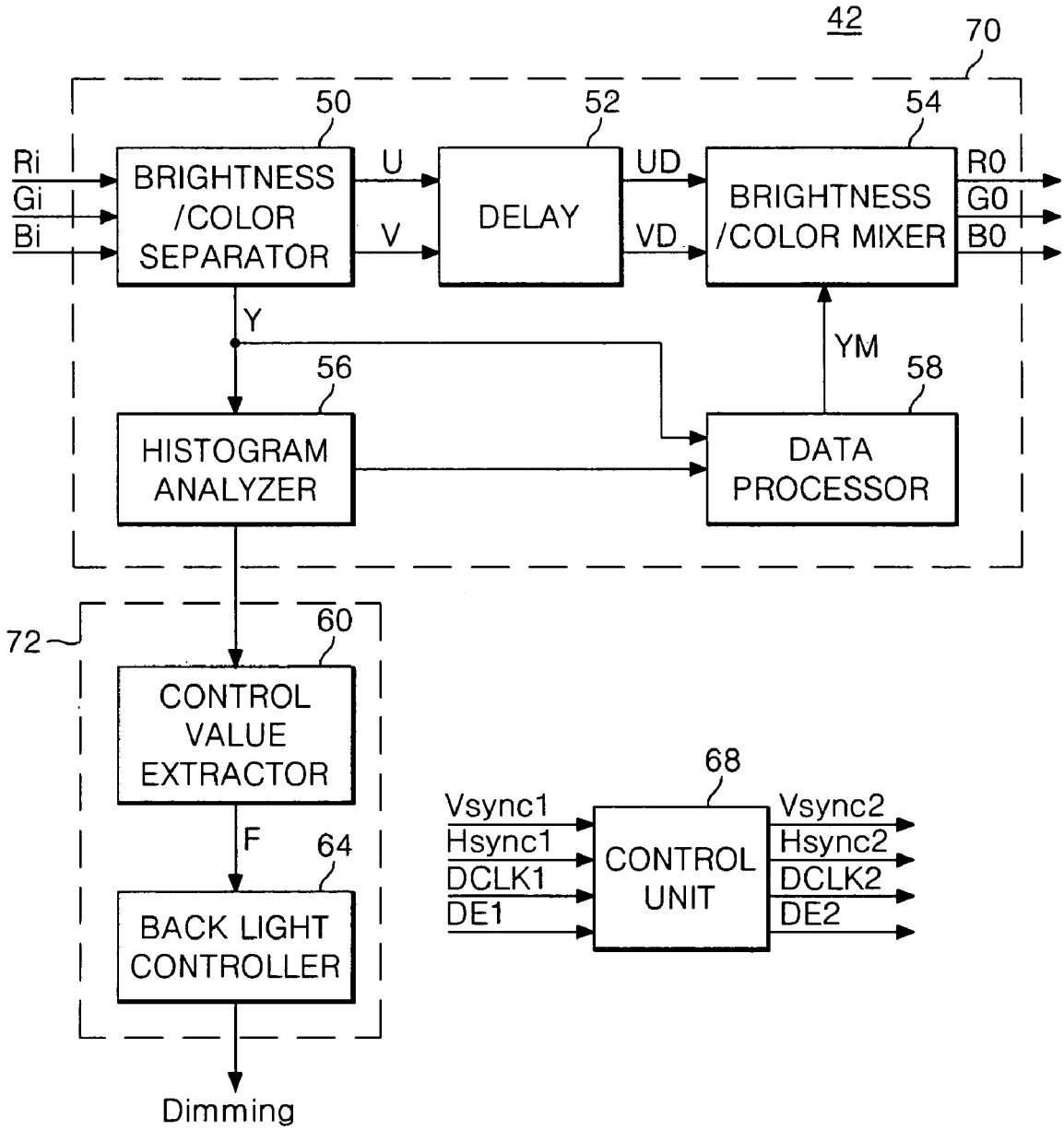
FIG. 3 is a block diagram of a first embodiment of the picture quality enhancer shown in FIG. 2.

To this end, as shown in FIG. 3, the picture quality enhancer 42 includes an image signal modulator 70 for generating the second data Ro, Go and Bo using the first data Ri, Gi and Bi, a back light controller 72 for generating the brightness control signal Dimming under control of the image signal modulator 70, and a control unit 68 for generating the second vertical/horizontal synchronizing signals Vsync2 and Hsync2, the second clock signal DCLK2 and the second enable signal DE2.

The image signal modulator 70 extracts brightness components Y from the first data Ri, Gi and Bi, and generates second data Ro, Go and Bo in which the contrast is partially emphasized with the aid of the extracted brightness components Y. To this end, the image signal modulator 70 includes a brightness/color separator 50, a, delay 52, a brightness/color mixer 54, a histogram analyzer 56 and a data processor 58.

The brightness/color separator 50 separates the first data Ri, Gi and Bi into brightness components Y and chrominance components U and V. The brightness components Y and the chrominance components U and V are obtained by the following equations:

$$Y=0.229\times Ri+0.587\times Gi+0.114\times Bi \quad (1)$$

$$U=0.493\times(Bi-Y) \quad (2)$$

$$V=0.887\times(Ri-Y) \quad (3).$$

Figure 4:
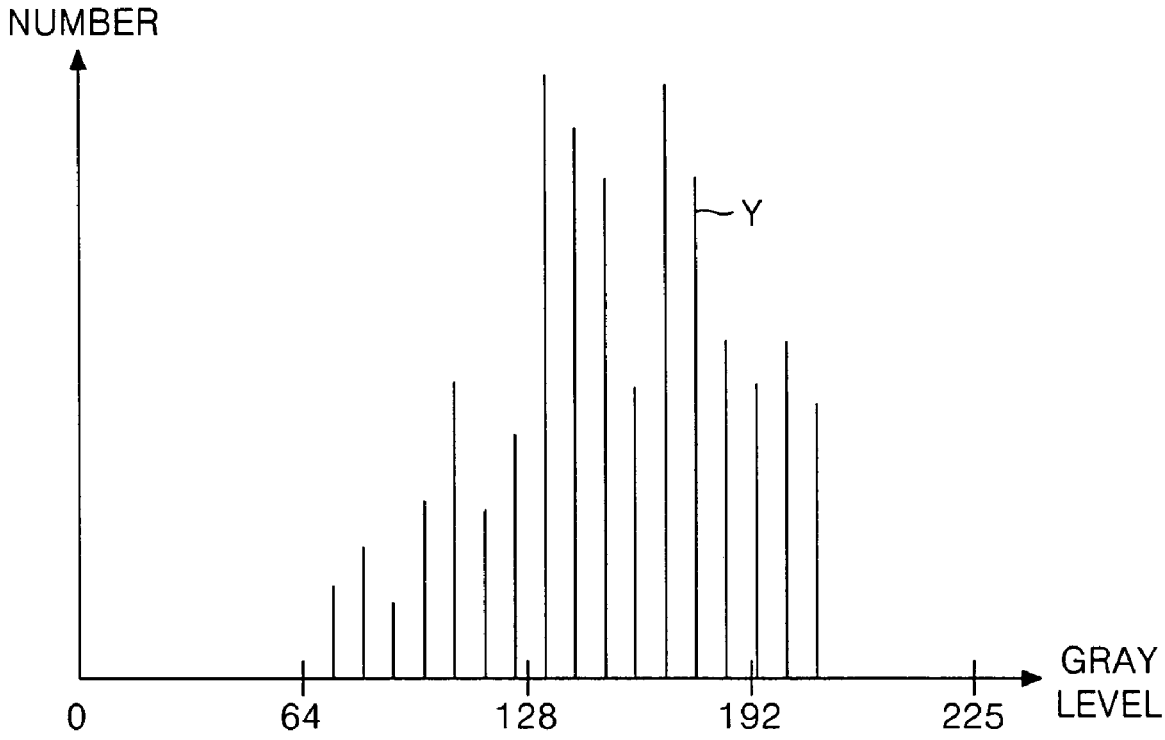
FIG. 4 is a graph showing an example of a histogram analyzed by the histogram analyzer shown in FIG. 3.

The histogram analyzer 56 divides the brightness components Y into gray levels for each frame. In other words, the histogram analyzer 56 arranges the brightness components Y for each frame to correspond to the gray levels, thereby obtaining a histogram as shown in FIG. 4. The shape of the histogram depends on the brightness components of the first data Ri, Gi and Bi.

The data processor 58 generates modulated brightness components YM having a selectively emphasized contrast using the analyzed histogram from the histogram analyzer 56. The data processor 58 generates modulated brightness components YM by various methods, such as those disclosed in Korean Patent Applications Nos. 2003-036289, 2003-040127, 2003-041127, etc., which have been filed previously by the applicants and are herein incorporated by reference in their entirety.

The delay 52 delays chrominance components U and V until the brightness components YM modulated by the data processor 58 are produced. Further, the delay 52 applies the delayed chrominance components UD and VD to the bright/color mixer 54 to be synchronized with the modulated brightness components YM.

The brightness/color mixer 54 generates second data Ro, Go and Bo with the aid of the modulated brightness components YM and the delayed chrominance components UD and VD. The second data Ro, Go and Bo is obtained by the following equations:

$$Ro=YM+0.000\times UD+1.140\times VD \quad (4)$$

$$Go=YM-0.396\times UD-0.581\times VD \quad (5)$$

$$Bo=YM+2.029\times UD+0.000\times VD \quad (6).$$

Since the second data Ro, Go and Bo obtained by the brightness/color mixer 54 has been produced from the modulated brightness components YM having an expanded contrast, they have more expanded contrast than the first data Ri, Gi and Bi. The second data Ro, Go and Bo produced such that the contrast can be expanded as mentioned above is applied to the timing controller 30.

The control unit 68 receives the first vertical/horizontal synchronizing signals Vsync1 and Hsync1, the first clock signal DCLK1 and the first data enable signal, DE1 from the system 40. Further, the controller 68 generates the second vertical/horizontal synchronizing signals Vsync2 and Hsync2, the second clock signal DCLK2 and the second data enable signal DE2 to be synchronized with the second data Ro, Go and Bo, and applies them to the timing controller 30.

The back light controller 72 extracts a control value from the histogram analyzer 56, and generates a brightness control signal Dimming using the extracted control value. The control value is variable, being dependent on the brightness components of each frame, and controls the brightness of the back light 38. As above, the control value can be, for example, the most-frequent and/or the average value.

The back light controller 72 includes a control value extractor 60 and a back light control 64.

Figure 5:
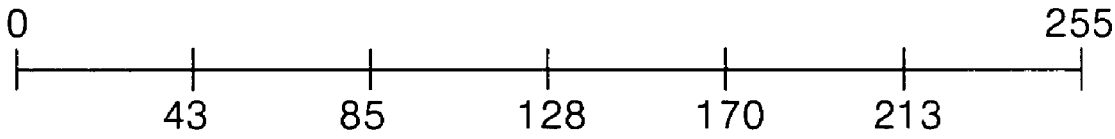
FIG. 5 depicts a brightness area for controlling brightness at the back light controller shown in FIG. 3.

As shown in FIG. 5, the back light control 64 divides the gray levels of the brightness components Y into a plurality of areas, and controls the back light 38 such that a different brightness can be supplied for each area. In other words, the back light control 64 determines the gray level of the control value, and generates a brightness control signal Dimming to correspond to the area to which the control value belongs.

The control value extractor 60 extracts a control value from the histogram analyzer 56 to apply it to the back light control 64.

An operation procedure of the back light controller 72 will be described in detail below.

First, the control value extractor 60 extracts a histogram analyzed by the histogram analyzer 56 to apply it to the back light control 64. The back light control 64 having received the control value checks the area to which a control value applied thereto belongs. In other words, the back light control 64 checks the area to which the control value belongs of a plurality of divided gray level values as shown in FIG. 5, and generates a brightness control signal Dimming corresponding thereto.

The brightness control signal Dimming from the back light control 64 is applied to the inverter 36. The inverter 36 controls the back light 38 in response to the brightness control signal Dimming, thereby applying a light corresponding to the brightness control signal Dimming to the liquid crystal display panel 22.

Accordingly, the present embodiment generates the second data Ro, Go and Bo having a contrast expanded in correspondence with the brightness components Y for one frame of the first data Ri, Gi and Bi, thereby displaying a vivid image. Furthermore, the present embodiment controls brightness of the back light 38 in correspondence with the brightness components Y for one frame of the first data Ri, Gi and Bi, thereby displaying a vivid image.

However, since the second data Ro, Go and Bo are generated and the brightness of the back light 38 controlled using only the brightness components of one frame, a sudden brightness variation caused by noise and the like may easily be generated. In other words, when the second data Ro, Go and Bo is generated and the brightness of the back light 38 controlled using the brightness components of a frame that includes a large amount of noise, a sudden brightness variation from the liquid crystal display panel 22 may be generated due to the noise components.

Moreover, if brightness of the liquid crystal display panel 22 is controlled using only brightness components of one frame, then the brightness may be changed suddenly in each frame. If brightness is changed suddenly in each frame as mentioned above, then sparkling may occur at the liquid crystal display panel 22.

Figure 6:
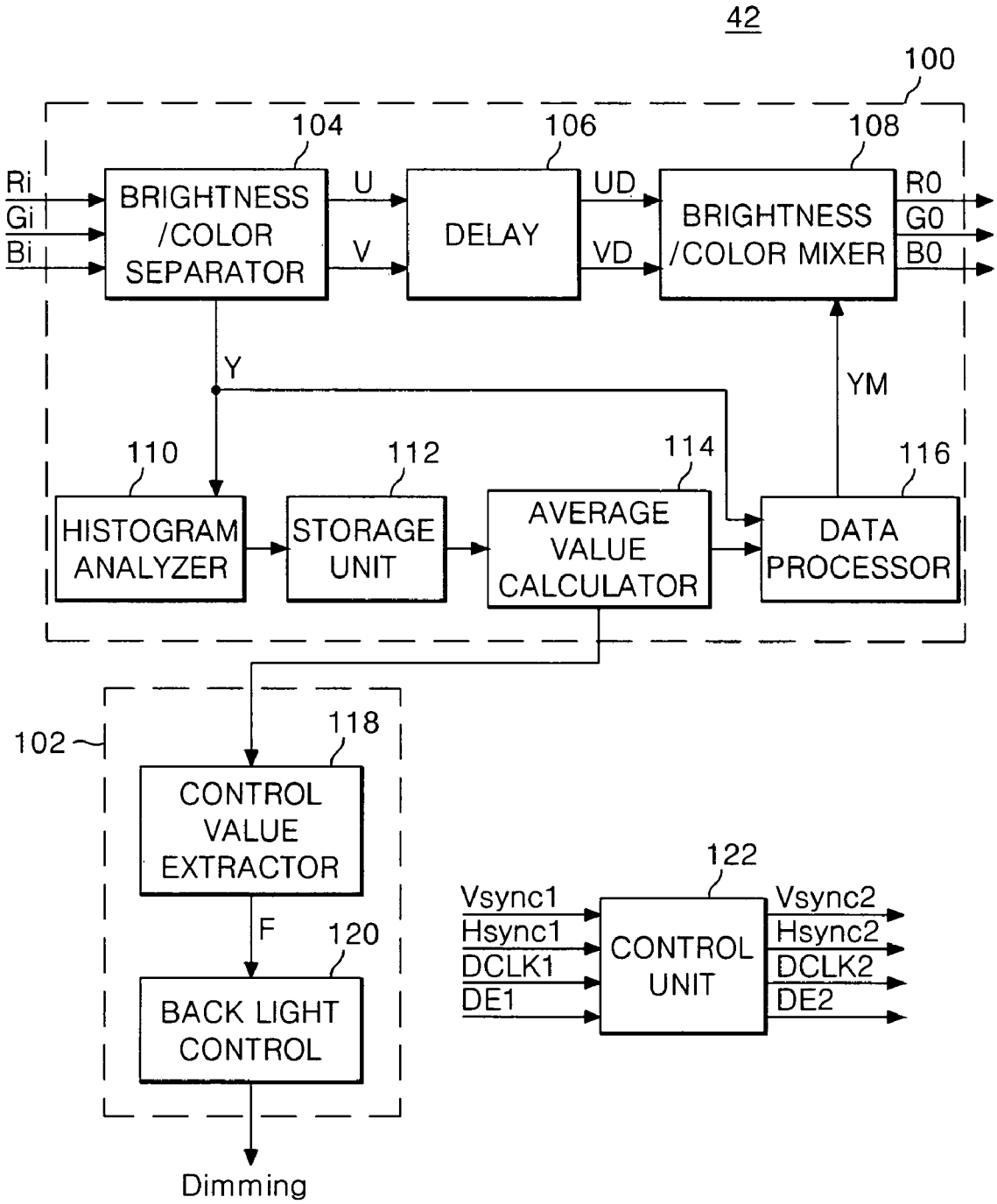
FIG. 6 is a block diagram of a second embodiment of the picture quality enhancer shown in FIG. 2.

In order to overcome such problems, a picture quality enhancer 42 according to another embodiment of the present invention is shown in FIG. 6.

Referring to FIG. 6, the picture quality enhancer 42 according to another embodiment of the present invention includes an image signal modulator 100 for generating second data Ro, Go and Bo using first data Ri, Gi and Bi, a back light controller 102 for generating a brightness control signal Dimming under control of the image signal modulator 100, and a control unit 122 for generating second vertical/horizontal synchronizing signals Vsync2 and Hsync2, a second clock signal DCLK2 and a second enable signal DE2.

The control unit 122 receives first vertical/horizontal synchronizing signals Vsync1 and Hsync1, a first clock signal DCLK1 and a first data enable signal DE1 from the system 40. Further, the control unit 122 generates the second vertical/horizontal synchronizing signals Vsync2 and Hsync2, the second clock signal DCLK2 and the second data enable signal DE2 to be synchronized with the second data Ro, Go and Bo, and applies them to the timing controller 30.

The image signal modulator 100 extracts brightness components Y from the first data Ri, Gi and Bi, and generates second data Ro, Go and Bo in which the contrast is partially emphasized with the aid of the extracted brightness components Y. To this end, the image signal modulator 100 includes a brightness/color separator 104, a delay 106, a brightness/color mixer 108, a histogram analyzer 110, a storage unit 112, an average calculator 114 and a data processor 116.

The brightness/color separator 104 separates the first data Ri, Gi and Bi into brightness components Y and chrominance components U and V using the above equations (1) to (3).

The histogram analyzer 110 divides the brightness components Y into gray levels for each frame. In other words, the histogram analyzer 110 arranges the brightness components Y of each frame to correspond to the gray levels, thereby obtaining a histogram as shown in FIG. 4. As above, the shape of the histogram depends on the brightness components of the first data Ri, Gi and Bi.

The storage unit 112 stores the histograms of at least two frames; the current frame and at least one earlier frame. The histograms of a plurality of frames adjacent to the current frame may be stored in the storage unit 112. For instance, the histograms of the ten frames preceding the current frame, as well as that of the current frame, may be stored in the storage unit 112.

Figure 7A:
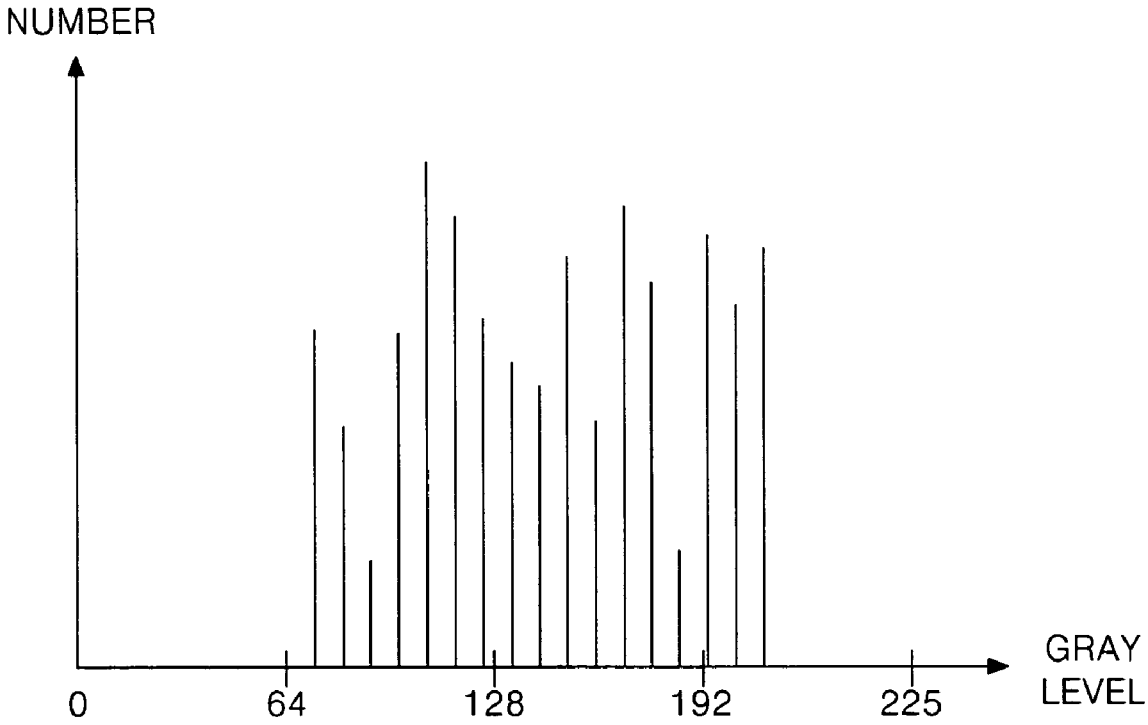
FIG. 7A to FIG. 7D are graphs showing examples of a histogram stored in the storage unit shown in FIG. 6.
Figure 7B:
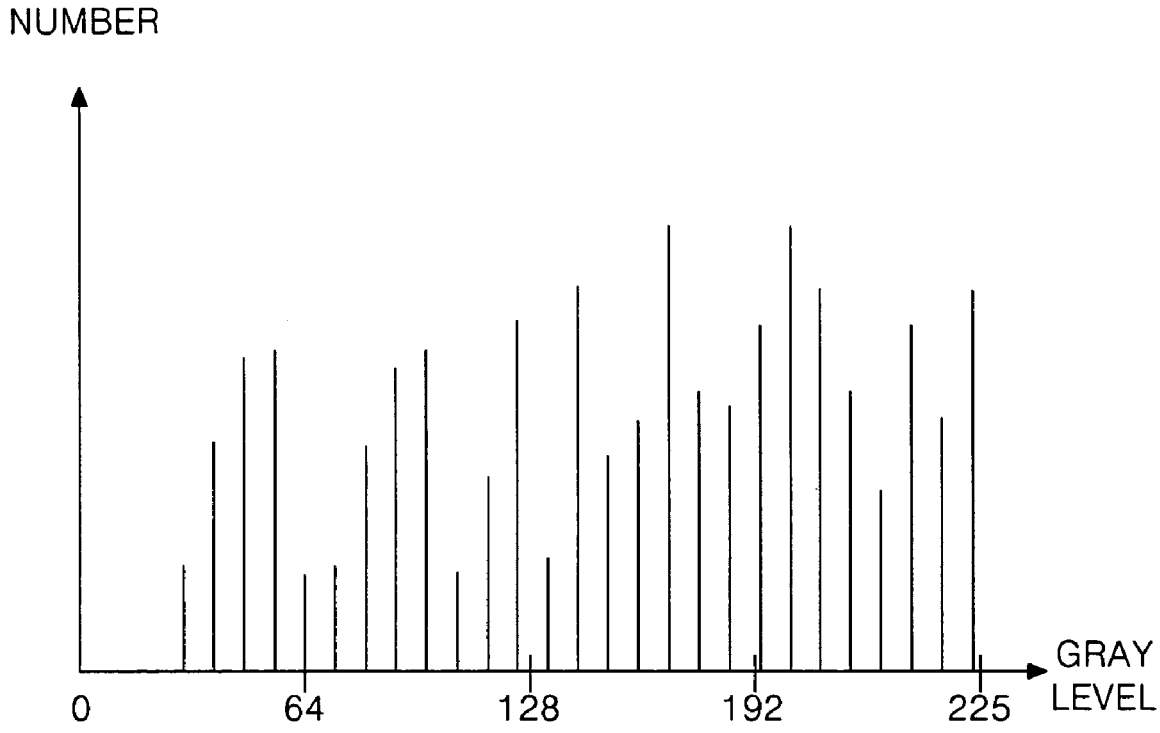
Figure 7C:
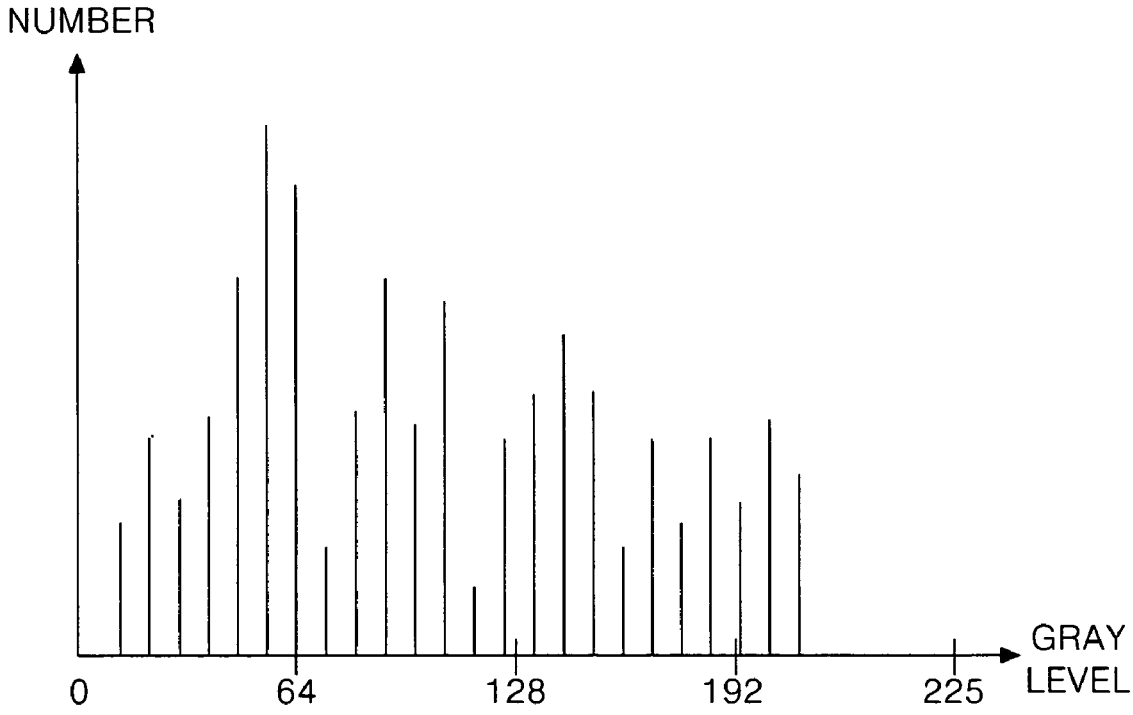
Figure 7D:
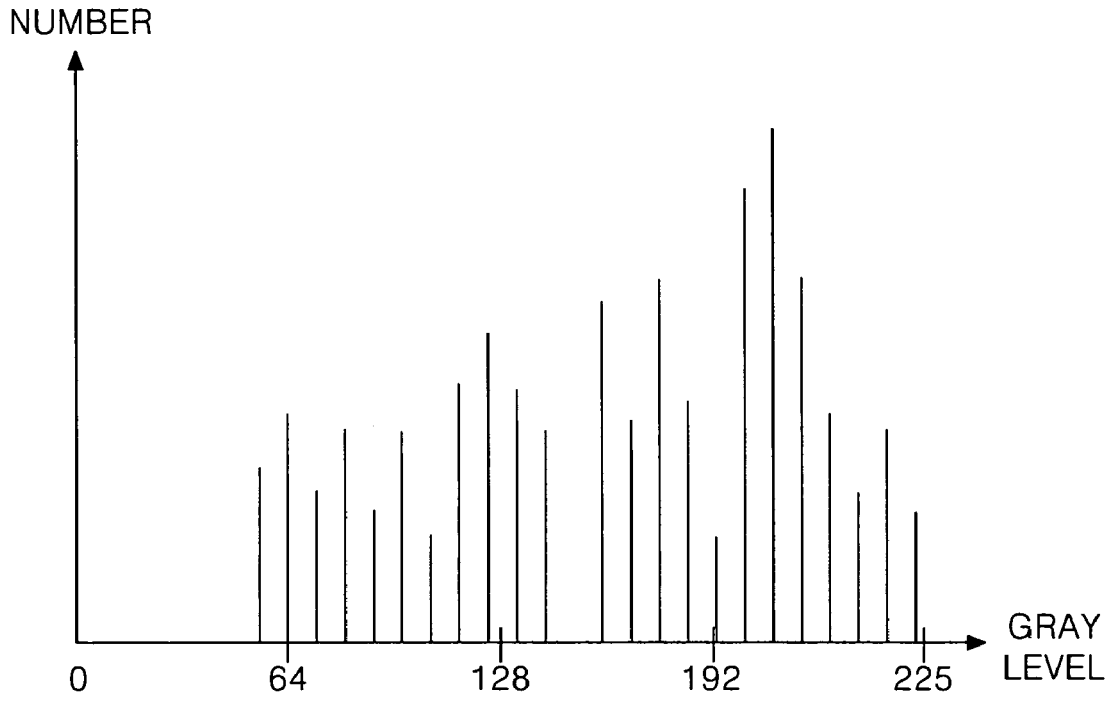

The average value calculator 114 calculates the average value of the brightness components in the histogram in the storage unit 112. For instance, each histogram having been stored in the storage unit 110 in shapes as shown in FIG. 7A to FIG. 7C is converted into an average value, thereby producing a single histogram of averages (i.e., an average histogram). The average calculator 114 converts control values stored in the storage unit 112 into an average value to thereby generate an average control value. The average control value extracted from the average histogram in other embodiments may be not identical to the average control value calculated by averaging the control values of each histogram.

The data processor 116 generates modulated brightness components YM having a selectively emphasized contrast using the average histogram calculated by the average value calculator 114. The various methods, incorporated by reference above, may be used to generate the modulated brightness components YM.

The delay 106 delays chrominance components U and V until the modulated brightness components YM are produced by the data processor 116. Further, the delay 106 applies the delayed chrominance components VD and UD to the brightness/color mixer 108 to be synchronized with the modulated brightness components YM.

The brightness/color mixer 108 generates second data Ro, Go and Bo with the aid of the modulated brightness components YM and the delayed chrominance components UD and VD. In other words, the brightness/color mixer 108 generates the second data Ro, Go and Bo having an emphasized contrast using the above equations (4) to (6). The second data Ro, Go and Bo is applied to the timing controller 30.

An operation procedure of the image signal modulator 100 will be described below.

Firstly, the brightness/color separator 104 applies the brightness components Y to the histogram analyzer 110 after separating the first data Ri, Gi and Bi into brightness components Y and chrominance components U and V. The histogram analyzer 110 having received the brightness components Y from the brightness/color separator 104 divides the brightness components Y into gray levels for each frame to generate a histogram, and then stores it into the storage unit 112. The storage unit 112 having received the histogram from the brightness/color separator 104 stores the histogram applied thereto. The histograms of a plurality of frames adjacent to the current frame are stored.

After the current histogram is stored in the storage unit 112, the average value calculator 114 produces an average histogram using the histograms stored in the storage unit 112. Further, the storage unit 112 can additionally average control values of each histogram to calculate an average control value. As the average histogram is produced from the storage unit 112, the data processor 116 generates modulated brightness components YM having an emphasized contrast using the average histogram. When the modulated brightness components YM having an emphasized contrast is generated from the data processor 116, the brightness/color mixer 108 generates the second data Ro, Go and Bo using the modulated brightness components YM.

Such an embodiment produces the average histogram using the histograms of at least two frames and generates the second data Ro, Go and Bo using the average histogram, so that a sudden change in the brightness of the second data Ro, Go and Bo can be prevented. In other words, in this embodiment, the data of the current frame is controlled using the results of a plurality of frames, to prevent a sudden change in the brightness of the current frame and sparkling. For instance, the embodiment generates the second data Ro, Go and Bo using the brightness components of a plurality of frames even though noise is present in a specific frame, thereby preventing a sudden change in the brightness caused by the noise.

The back light controller 102 extracts a control value from the average value calculator 114, and generates a brightness control signal Dimming using the extracted control value. The control value controls the brightness of the back light 38. For instance, the control value can be the most-frequent value and/or the average value.

The back light controller 102 includes a control value extractor 118 and a back light control 120.

The control value extractor 118 extracts the control value from the average histogram calculated by the average value calculator 114 to apply it to the back light control 120. The control value extractor 118 averages the control value of each histogram from the average value calculator 114, and extracts the calculated control value when the average control value has been calculated.

As shown in FIG. 5, the back light control 120 divides gray levels of the brightness components Y into a plurality of areas, and controls the back light 38 such that a different brightness of light can be supplied for each area. In other words, the back light control 120 generates a brightness control signal Dimming to correspond to a control value applied thereto.

An operation procedure of the back light controller 102 will be described in detail below.

First, the control value extractor 118 extracts a control value from the average value calculator 114 to apply it to the back light control 120. The back light control 120 having received the control value checks an area to which a control value applied thereto belongs. In other words, the back light control 120 checks an area to which the control value belongs, of a plurality of divided gray level values as shown in FIG. 5, and generates a brightness control signal Dimming corresponding thereto. For instance, the back light control 120 generates a brightness control signal Dimming such that the amount of brightness increases as the gray level area to which the control value belongs increases.

The brightness control signal Dimming from the back light control 120 is applied to the inverter 36. The inverter 36 controls the back light 38 in response to the brightness control signal Dimming, thereby applying light corresponding to the brightness control signal Dimming to the liquid crystal display panel 22.

Such an embodiment controls the brightness of the back light 38 using a control value extracted from a brightness component histogram of at least two frames, so that a sudden change in the brightness can be prevented. In other words, the brightness of the back light 38 is controlled using an average histogram calculated from the plurality of frames to prevent a sudden change in the brightness between frames. Thus, it becomes possible to prevent sparkling from being generated in the liquid crystal display panel 22. Furthermore, in another embodiment, the noise that affects a specific frame does not significantly affect the brightness of the average histogram. In other word, the back light 38 is controlled using the average histogram calculated from a plurality of frames, so that the brightness is not suddenly changed due to the noise in the specific frame.

Figure 8:
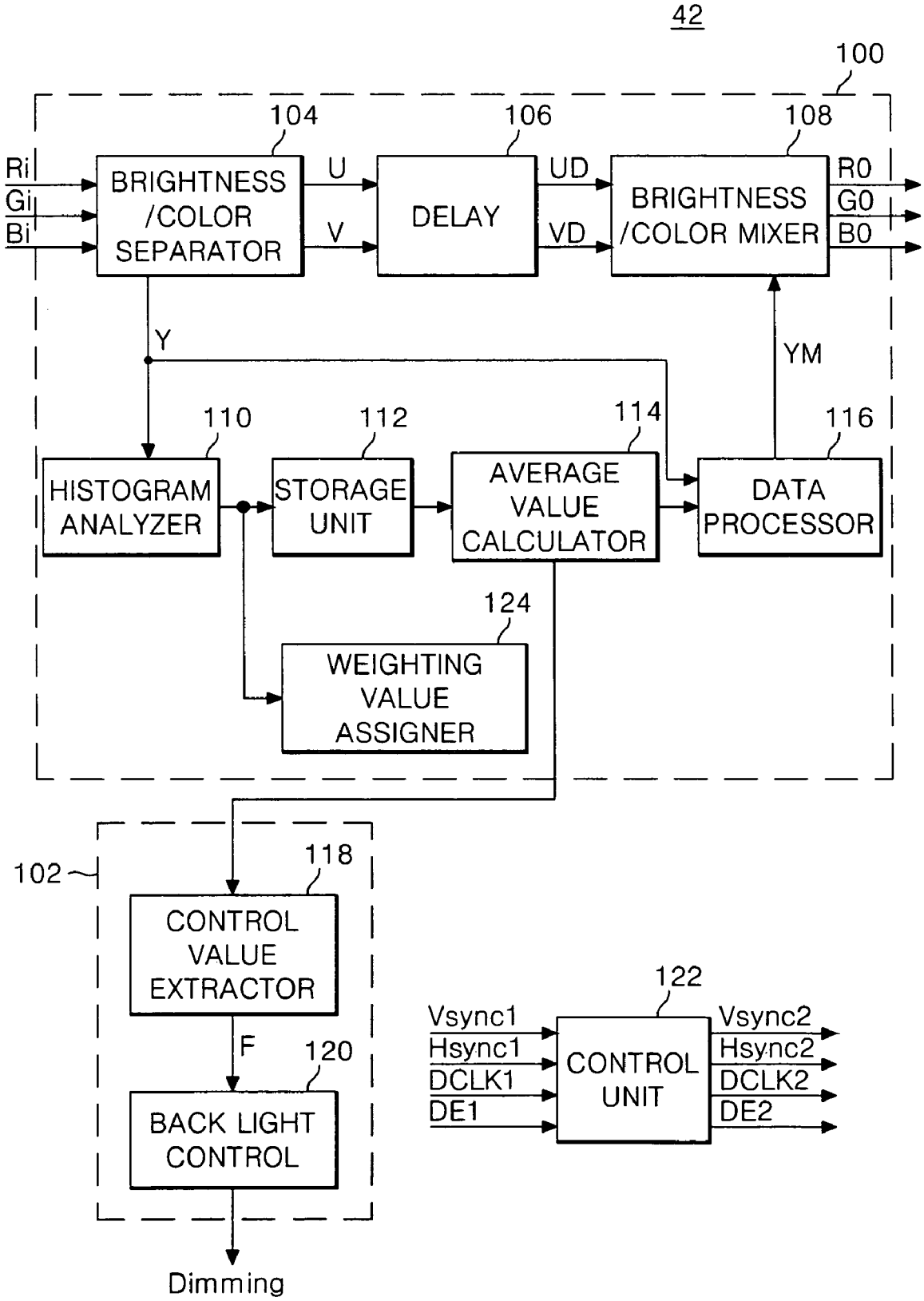
FIG. 8 is a block diagram of a third embodiment of the picture quality enhancer shown in FIG. 2.

Another embodiment of the present invention includes a weighting value assigner 124 as shown in FIG. 8 such that the histogram of the current frame has a larger affect that the histogram of the adjacent frame when the average histogram is calculated from the plurality of frames.

The weighting value assigner 124 assigns a weighting value to the histograms of a plurality of frames stored in the storage unit 112. In one embodiment, the weighing value assigner 124 assigns a higher weighting value as the histogram approaches the current frame.

For instance, the weighting value assigner 124 assigns weighting values to the histograms stored in the storage unit as indicated in the following equation:

$$H^5 \times i + H^4 \times 2i + H^3 \times 3i + H^2 \times 4i + H^1 \times 5i \quad (7)$$

In the above equation, 'H' of "$H^X$" represents a histogram, and "X' represents the position of frame with respect to distance from the current histogram. Thus, a larger value of "X" means the histogram is farther from the current frame while a smaller value of "X" means the histogram is closer to the current frame.

As can be seen from the above equation (7), the weighting value assigner 124 assigns a higher weighting value i to a frame closer to the current frame and accordingly a lower weighting value i to a frame farther from the current frame. A higher weighting value is assigned to a frame closer to the current frame because a frame closer to the current frame has an image that is generally more analogous to the currently displayed image than images of frames further away from the current histogram, thereby producing an average histogram having a pattern analogous to an image displayed in the current frame from the average value calculator 114.

As described above, according to the present invention, brightness components are extracted from first data and second data having an expanded contrast is produced with the aid of the extracted brightness components. The brightness of the back light is controlled using the brightness components extracted from the first data, thereby displaying a vivid image. Moreover, according to the present invention, the brightness of the liquid crystal display panel is controlled using results of a plurality of frames, so that it becomes possible to prevent a sudden variation in the brightness of the liquid crystal display panel caused by noise, etc. In other words, according to the present invention, brightness of the liquid crystal display panel is controlled using results of a plurality of frames, so that brightness of the liquid crystal display panel is not suddenly changed. Thus, it becomes possible to prevent sparkling of the liquid crystal display panel.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a display, the method comprising:

(A) converting first data of a current frame into brightness components and chrominance components;

(B) arranging the brightness components into a histogram;

(C) storing histograms of the brightness components of a plurality of frames, wherein storing the histograms comprises storing histograms of at least two frames adjacent to the current frame;

(D) generating an average histogram from the stored histograms, wherein generating the average histogram comprises assigning weighting values to the stored histograms having values that decrease as the frames from which the stored histograms are generated increase in distance from the current frame;

(E) converting brightness components of the average histogram to have an expanded contrast;

(F) generating second data having an expanded contrast from that of the first data using the converted brightness components and the chrominance components; and (G) re-arranging the second data such that the second data can be applied to a liquid crystal display panel, thereby applying the re-arranged second data to a data driver;

(H) controlling brightness of a back light using the stored histograms, wherein controlling the brightness of the back light comprises extracting a control value from the average histogram, and controlling the brightness of the back light in correspondence with the control value;

wherein the back light applies light to the liquid crystal display panel;

wherein the control value is a most-frequent value occupied by the maximum number of brightness components in the average histogram.

2. The method of claim 1, further comprising delaying the chrominance components such that the chrominance components are synchronized with the converted brightness components.

3. The method of claim 1, further comprising converting synchronizing signals inputted in synchronization with the first data to be synchronized with the second data.

4. A method of driving a display, comprising:

(A) converting data of each frame to be displayed into brightness components;

(B) arranging the brightness components into a histogram; and (C) controlling brightness of a back light using histograms of the brightness components of at least two frames, wherein (C) comprises extracting a control value from each of the histograms, averaging the extracted control values to calculate an average control value, and controlling the brightness of the back light in correspondence with the average control value;

assigning a weighting value to each of the histograms such that histograms have increasing effect with respect to the brightness of the back light as the frames from which the histograms are generated decrease in distance from a current frame, wherein the histograms have values that decrease as the frames from which the stored histograms are generated increase in distance from the current frame;

wherein the back light applies light to a liquid crystal display panel;

wherein each control value is a most-frequent value occupied by the maximum number of brightness components in the average histogram.

5. The method of claim 4, wherein the brightness components are divided into a plurality of brightness areas and the brightness of the back light is controlled corresponding to the brightness area to which the control value belongs.

6. The method of claim 5, wherein the brightness of the back light is set differently for each area to which the control value belongs.

7. A driving apparatus for a display, comprising:

a brightness/color separator for extracting brightness components from first data;

a histogram analyzer for converting the brightness components of each frame into a histogram;

a storage for storing histograms of at least two frames analyzed by the histogram analyzer;

an average value calculator for generating an average histogram from the stored histograms, wherein the average value calculator averages control values from the stored histograms to calculate an average control value; and a data processor for expanding a contrast of the brightness components using the average histogram;

a weighting value assigner for assigning weighting values to the stored histograms, wherein the weighting value assigner assigns weighting values to the stored histograms having values that decrease as the frames from which the stored histograms are generated increase in distance from a current frame when producing the average histogram;

a back light controller for controlling brightness of a back light using a control value of the average histogram or the average control value;

wherein the back light applies light to a liquid crystal display panel;

wherein each control value is a most-frequent value occupied by the maximum number of brightness components in the average histogram.

8. The driving apparatus of claim 7, further comprising:

a brightness/color mixer for generating second data having an expanded contrast using converted brightness components and chrominance components from the data processor; and a delay for delaying the chrominance components such that the chrominance components are synchronized with the converted brightness components.

* * * * *